US006099452A

United States Patent [19]

Hoza et al.

[11] Patent Number: 6,099,452

[45] Date of Patent: Aug. 8, 2000

[54] FORMS STACKER

[75] Inventors: Thomas J. Hoza, Rochester; James C. Folsom, Sanford; Robert E. Godfrey, Rochester, all of N.H.

[73] Assignee: Moore Business Forms, Inc., Grand Island, N.Y.

[21] Appl. No.: 08/396,243

[22] Filed: Mar. 1, 1995

[51] Int. Cl.[7] ..... B31F 1/08; B65H 45/20; B41L 1/32; B65G 57/03

[52] U.S. Cl. ..... 493/416; 271/163; 271/218; 270/39.02; 270/39.05; 270/40; 270/58.19; 270/58.28; 414/790.1; 414/790.4; 414/794.4; 414/926

[58] Field of Search ..... 493/411, 412, 493/413, 414, 415, 27, 29, 416; 271/163, 217, 218, 58.19, 58.28, 40, 39.02, 39.05; 414/790, 790.1, 790.4, 926, 794.4; 270/39, 58, 58.19, 58.29, 40, 39.02, 39.05

[56] References Cited

U.S. PATENT DOCUMENTS

| | | | |
|---|---|---|---|
| 1,719,197 | 7/1929 | Schlothan . | |
| 2,218,062 | 10/1940 | Yates | 493/415 |
| 2,661,949 | 12/1953 | Bauer . | |
| 3,113,771 | 12/1963 | Tucci | 493/416 |
| 3,208,604 | 9/1965 | Taylor et al. . | |
| 3,507,492 | 4/1970 | Spencer | 271/218 |
| 3,548,995 | 12/1970 | Oderman et al. | 271/218 |
| 3,556,326 | 1/1971 | Cline . | |
| 3,591,019 | 7/1971 | Beninger et al. | 414/790 |
| 3,724,640 | 4/1973 | Rapparlie | 414/790.4 |
| 3,739,924 | 6/1973 | Stobb | 414/794.4 |
| 3,883,131 | 5/1975 | Anderson, Jr. et al. | 493/416 |
| 3,887,088 | 6/1975 | Fernandez-Rana et al. | 214/6 |
| 3,937,456 | 2/1976 | Groudis et al. | 271/217 |
| 3,969,993 | 7/1976 | Stobb | 271/218 |
| 3,974,921 | 8/1976 | Tokuno | 214/7 |
| 4,019,640 | 4/1977 | Marin et al. | 271/218 |
| 4,030,720 | 6/1977 | Jones | 493/413 |
| 4,054,283 | 10/1977 | Rayfield | 493/413 |
| 4,103,786 | 8/1978 | Tokuno | 214/7 |
| 4,416,653 | 11/1983 | Breski et al. | 493/413 |
| 4,429,889 | 2/1984 | Westra | 280/79.1 |
| 4,457,656 | 7/1984 | Kosina et al. . | |
| 4,541,763 | 9/1985 | Chandhoke et al. | 414/790 |
| 4,573,958 | 3/1986 | Biesinger | 493/415 |
| 4,577,853 | 3/1986 | Duke | 271/217 |
| 4,621,969 | 11/1986 | Berghall et al. . | |
| 4,750,724 | 6/1988 | Herd et al. | 270/39.02 |
| 4,765,790 | 8/1988 | Besemann | 414/926 |

(List continued on next page.)

OTHER PUBLICATIONS

Roll Systems Inc. Forms Transfer System brochure, Nov., 1992.

*Primary Examiner*—Michael J. Carone
*Assistant Examiner*—Darren Ark
*Attorney, Agent, or Firm*—Nixon & Vanderhye P.C.

[57] ABSTRACT

A stacker and cart are provided for vertically stacking forms fed from a printer, folder, or other mechanism, by a conveyor, which do not require tilting of the cart to allow offloading of the forms. The stacker has a housing with side walls parallel to and spaced from each other in a first dimension and a base which mounts the side walls so that they are inclined with respect to the vertical (e.g. about 15 degrees), tilted in a second dimension perpendicular to the first. A number of forms-supporting stacker tines are parallel to and spaced from each other in the first dimension, and an elevator mechanism moves the tines in unison generally vertically with respect to the side walls. A stacker cooperates with a cart, a part sensor mounted on or adjacent the stacker base, and a latch on the cart cooperating with a latching mechanism on the stacker. The cart has a forms engaging face making the same angle to the vertical as the stacker side walls, and cart tines extend outwardly from the face parallel to and spaced from each other in the first dimension and intermeshed with the stacker tines so that the stacker and cart tines do not interfere with each other as the stacker tines are moved by the elevator mechanism relative to the cart tines. The cart preferably has a second face and tines on the opposite side of a movable base from the first face and tines.

23 Claims, 6 Drawing Sheets

U.S. PATENT DOCUMENTS

| | | | |
|---|---|---|---|
| 4,787,799 | 11/1988 | Platteschorre . | |
| 4,842,573 | 6/1989 | Peter et al. | 270/39.02 |
| 4,880,350 | 11/1989 | Stobb | 271/217 |
| 4,917,364 | 4/1990 | Iida et al. . | |
| 4,951,803 | 8/1990 | Dorner et al. | 414/790 |
| 4,977,827 | 12/1990 | Chandhoke et al. | 414/790 |
| 4,993,916 | 2/1991 | Dormer | 414/790 |
| 4,997,339 | 3/1991 | Antonis | 414/790.1 |
| 5,026,038 | 6/1991 | Weller et al. | 271/163 |
| 5,061,233 | 10/1991 | Schultz et al. | 493/416 |
| 5,069,598 | 12/1991 | Kleinhen et al. | 414/790 |
| 5,090,678 | 2/1992 | Green | 270/39.02 |
| 5,096,181 | 3/1992 | Menon et al. | 271/163 |
| 5,190,281 | 3/1993 | Cardenas | 271/218 |
| 5,215,428 | 6/1993 | Masini | 414/790 |
| 5,273,516 | 12/1993 | Crowley | 493/416 |
| 5,279,536 | 1/1994 | Abreu | 414/790 |
| 5,318,401 | 6/1994 | Mandel | 271/217 |
| 5,320,336 | 6/1994 | Asami | 270/58.08 |
| 5,322,496 | 6/1994 | Ernst et al. | 493/410 |
| 5,387,077 | 2/1995 | Yatsuka et al. | 414/790.4 |
| 5,413,449 | 5/1995 | Schoenherr et al. | 414/343 |
| 5,460,479 | 10/1995 | Neumann et al. | 414/789.5 |

10
11
40
41
42
43
45
46
47
50
51
53
58
59
60
60'
61
63
64
65
66
67
68
69
70
71
72
73
74
76
101
103
104

FORMS STACKER

BACKGROUND AND SUMMARY OF THE INVENTION

In the high production of business forms, particularly folded forms which are then sealed and otherwise acted upon by processing equipment (such as a Moore pressure seal system available form Moore Business Forms, Lake Forest, Ill.), typically, the forms are printed, folded, and then collected so that they can be moved to other processing equipment and readily taken off from the other processing equipment. In the past several years this has been normally effectively accomplished utilizing tilting carts, such as shown in U.S. Pat. Nos. 5,061,233, 5,273,516, and 5,322,496. These carts allow ready transport of the fan-folded forms from the folding or like processing equipment, to other types of processing equipment. The carts are typically tiltable because it is easier when the forms are moved to the subsequent processing equipment to take the forms off of a vertical stack, particularly fan-folded forms. However, there are some drawbacks associated with tilting carts.

Depending upon the particular forms being processed, and how many forms are necessary to stack in order to effectively perform the necessary handling functions for the forms, the forms may be damaged or curled as a result of storage and compression on the tilt cart. Also, full carts of forms may be very heavy and unmanageable for an operator to successfully tilt, at least without damaging of the forms, which can slow down the entire forms processing system.

According to the present invention equipment is provided which eliminates the problems associated with tilting carts in the processing of business forms. According to the present invention a unique stacker and a unique cart are both provided, the stacker and cart cooperating to allow stacking of the forms in such a way that a vertical stack is immediately formed from a conveyor (e.g. associated with a folder, printer, or the like), the cart having a fixed angular orientation that allows proper stacking and takeoff of the forms, yet does not require tilting action by the operator. Thus, the forms may be readily manipulated and moved from one position to the other and then readily taken off the cart, without curling or other damage to the forms.

According to one aspect of the present invention a unique stacker is provided. The stacker comprises the following components: A housing including first and second generally vertical side walls, and a base, the side walls substantially parallel to each other and spaced in a first dimension. A plurality of forms-supporting tines parallel to and spaced from each other in the first dimension. The base including support portions which mount the side walls and tines so that the tines and/or side walls are inclined with respect to the vertical more than two degrees, tilted in a second dimension, substantially perpendicular to the first dimension. And an elevator mechanism for moving the forms-supporting tines together in a generally vertical dimension with respect to the side walls.

A cart sensor is typically mounted on or adjacent the base for sensing positioning of a cart in operative association with the forms supporting stacker tines and a latching mechanism is also preferably mounted adjacent the base for cooperating with a latch on a cart to latch a cart in place until released. A forms position sensor for sensing the position of stacked forms on the forms supporting tines is mounted on the side walls and control means are provided for effecting movement of the elevator mechanism with respect to the side walls, and thus movement of the forms supporting tines, in response to the forms position sensor.

The elevator mechanism may comprise a pair of endless chains each connected to an idler sprocket and a drive sprocket, a drive for rotating the drive sprockets, and a support arm for connecting the forms engaging tines to the chains and movement therewith. An indicator lamp may also be provided for indicating when a stack of forms of a predetermined size has been stacked on the forms supporting tines, the indicator lamp mounted adjacent the top of the side walls. The side walls and the forms supporting tines are typically inclined to the vertical about 15 degrees in the second dimension (e.g. about 5–25 degrees).

The invention also relates to a cart for transporting business forms. The cart comprises the following components: A base. A first forms-engaging face mounted to the base has a fixed angular position making an angle of about 5–25 degrees with respect to the vertical. A second forms-engaging face having a fixed angular position making the same angle with respect to the vertical as the first face, and also mounted to the cart base. Transport means on the base for facilitating rolling movement of the base. A first plurality of cart tines extending outwardly from the first face and parallel to and spaced from each other in a first dimension. A second plurality of cart tines extending outwardly from the second face and parallel to and spaced from each other in the first dimension. And the first and second faces mounted so that individual tines of the first and second pluralities of tines are substantially co-planar.

First and second latches are preferably mounted to or adjacent the base, the first latch extending outwardly from the first face generally perpendicular thereto and the second latch extending outwardly from the second face generally perpendicular thereto. Adjustment means are typically provided for adjusting the positions of the first and second plurality of tines with respect to the first and second faces, respectively, to individually vary the forms stacking capacity of the cart faces. For example, the tines may be made of sheet metal and connected by hooks in slots formed in the cart face, similar to conventional shelving connections. Typically a plurality of handles extends upwardly from the faces, facilitating movement of the cart.

The invention also relates to a stacker and cart assembly for substantially vertically stacking the forms. The assembly comprises: A stacker comprising: A housing including first and second generally vertical side walls, and a stacker base, the side walls substantially parallel to each other and spaced in a first dimension; a plurality of forms-supporting stacker tines parallel to and spaced from each other in the first dimension; and an elevator mechanism for moving the forms-supporting stacker tines together in a generally vertical dimension with respect to the side walls. And a cart comprising: A cart base; a forms-engaging face mounted to the cart base; transport means on the cart base for facilitating rolling movement of the cart base; and a plurality of cart tines extending outwardly from the face and parallel to and spaced from each other in the first dimension a spacing greater than the width of at least some of the stacker tines, so that when the cart is brought into operative position with the stacker the stacker and cart tines do not interfere with each other as the stacker tines are moved by the elevator mechanism relative to the cart tines.

A cart sensor mounted on or adjacent the stacker base precludes operation of the elevator mechanism unless the cart is in place with respect to the stacker. The cart and stacker are both preferably as described above in detail.

It is a primary object to provide an effective alternative to tilting carts in the handling of business forms. This and other objects of the invention will become clear from a detailed description of the invention, and from the appended claims.

DETAILED DESCRIPTION OF THE DRAWINGS

Figure 1:
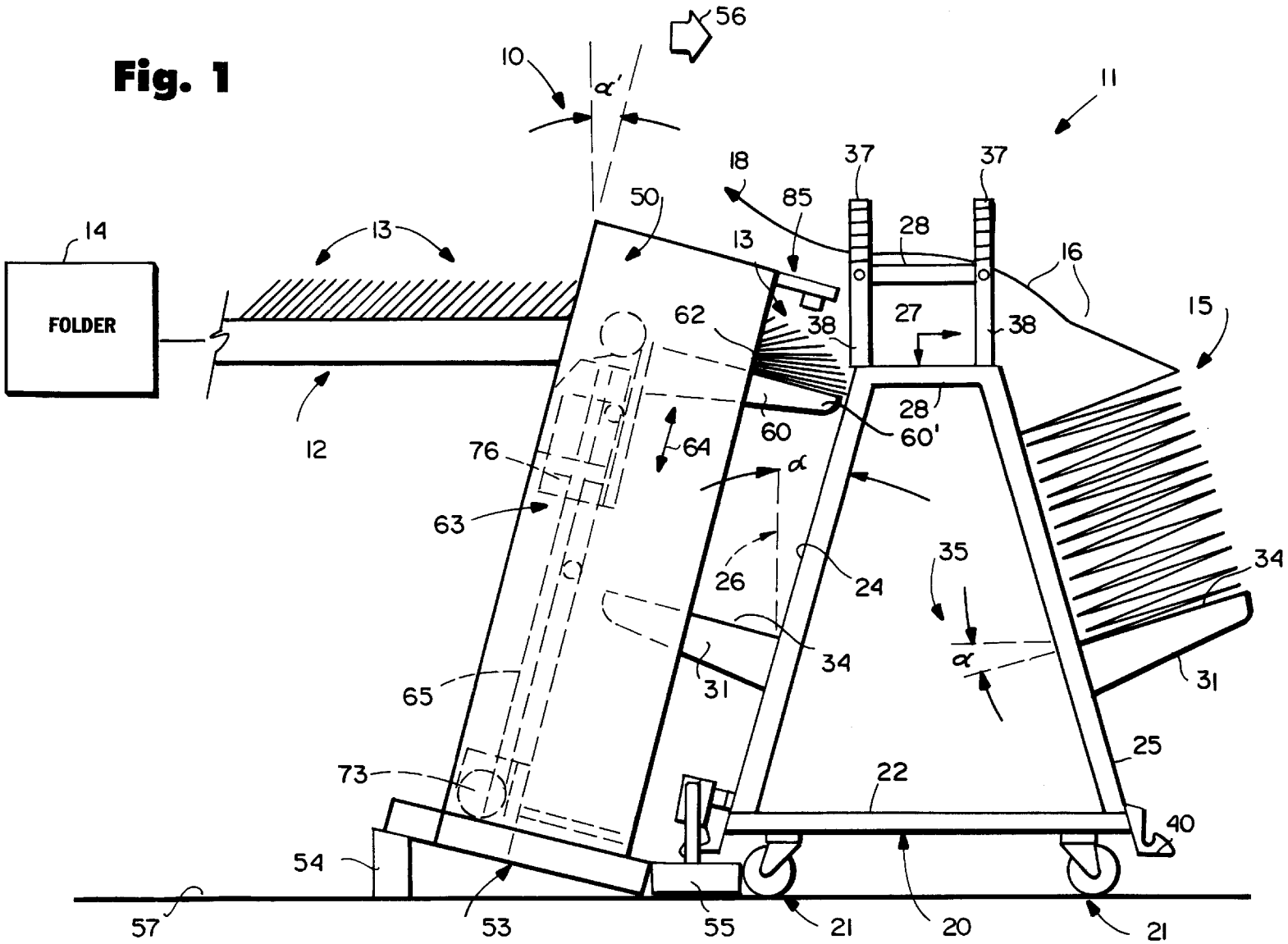
FIG. 1 is a side schematic view illustrating the cooperation of a cart and stacker according to the present invention in the stacking, and takeoff (the right hand face of the cart of FIG. 1) in use of the equipment according to the invention.

An exemplary vertical stacker according to the present invention is shown generally by reference numeral 10 in FIG. 1, while an exemplary cart according to the present invention is shown generally by reference numeral 11. The stacker 10 is typically fed by a conveyor 12 which conveys the fan-folded business forms 13, the forms 13 typically moving on the conveyor mechanism 12 (which may be a powered conveyor such as a belt or chain conveyor, or merely a conveyor table that the forms are pushed along) tilted on end and loosely compacted. The conveyor mechanism 12 is typically associated with another piece of handling equipment such as a printer, folder (schematically illustrated at 14 in FIG. 1), and/or other piece of handling equipment.

The purpose of the stacker 10 and the cart 11 is to generally vertically stack the forms 13—as shown by the generally vertical stack 15 seen at the right side of FIG. 1—to allow easy takeoff of the forms from the stack 15 to be handled by another piece of equipment, such as a bursting, sealing, mailing, and/or like piece of equipment. The right hand side of FIG. 1 shows individual forms 16, still fan-folded, being taken off from the stack 15 and passing over a roller 17 (see FIG. 2) associated with the cart 11 to be fed to another piece of equipment as indicated schematically by the arrow 18 in FIG. 1. However, it is to be understood that the cart 11 illustrated in FIG. 1 is in a position with the stacker 10 to receive forms, and that the cart 11—once both faces thereof (as will be hereinafter described) are filled—is moved to another location prior to takeoff of the individual forms 16 from a stack 15, as illustrated in the right side of FIG. 1.

The cart 11 is designed so that no tilting thereof is necessary. The forms are initially stacked in a vertical manner in association with the cart 11, and while that same orientation is maintained, the forms 16 are taken off.

Figure 2:
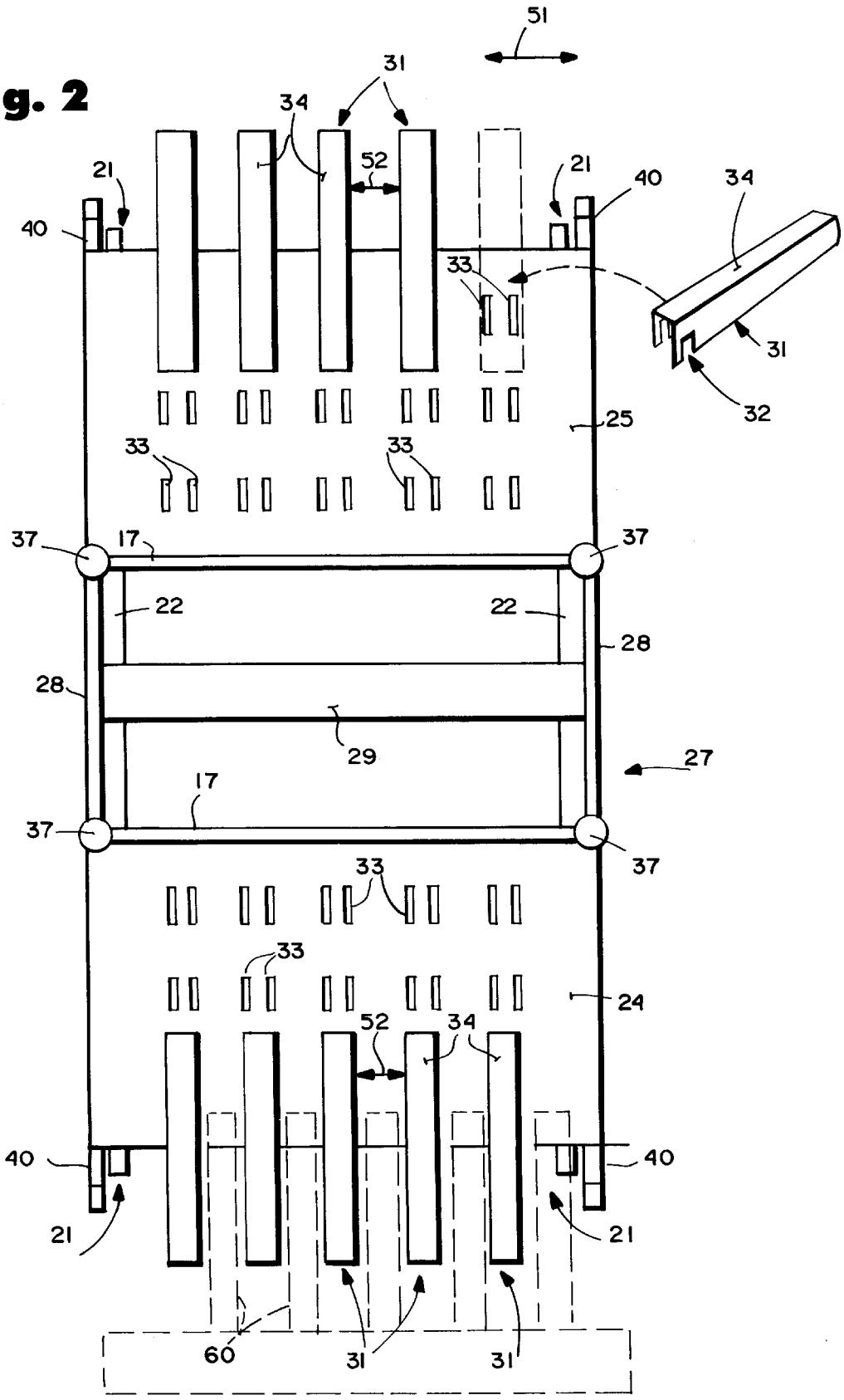
FIG. 2 is a top plan schematic view of the cart of FIG. 1, and showing one of the cart tines detached and in perspective.

In the preferred embodiment most clearly illustrated in FIGS. 1 and 2, the cart 11 comprises a base 20 with transport means 21 on the base 20 for facilitating rolling movement of the base 20. For example, the base 20 may comprise four steel beams or angles rigidly held together in a quadrate configuration, only the side beams or angles 22 being visible in FIGS. 1 or 2. Any suitable components may be provided for the base, however. The base 20 transport means 21 may comprise any suitable components. FIGS. 1 and 2 schematically illustrate wheels (which may be locked in place) as the transport means 21, but it is to be understood that rollers, casters, low friction slides, or virtually any other conventional mechanisms may be utilized for mounting the base 20. While in the preferred embodiment illustrated in FIGS. 1 and 2 four wheels 21 are provided, it is to be understood that under some circumstances wheels may be provided on only one side of the cart, or three sets of wheels rather than four may be provided, or more than four.

The cart 11 comprises first and second forms-engaging faces 24, 25 mounted to the base 20 with a fixed angular position. For example, as seen in FIG. 1, faces 24, 25 may be mounted so that they both have the same angle $\alpha$ with respect to the vertical (shown in dotted line at 26 in FIG. 1), the angle $\alpha$ preferably being about 15 degrees, but it may be in a wider range, e.g. about 5–25 degrees. If the faces 24, 25 have an angle $\alpha$ of 16 degrees the tines 31 have an angle $\beta$ of about 15 degrees. The faces 24, 25 preferably are pieces of sheet metal, and they are held with the fixed angular orientation $\alpha$ by rigid connection to the base 20, and also by rigid connection to an upper supporting assembly shown generally by reference numeral 27 in FIGS. 1 and 2. The upper assembly 27 may comprise side bars or angles 28, in fact two sets thereof as seen in FIGS. 1, the rollers 17 (which may either be rotatable rollers or stationary rods), and a cross brace 29 (see FIG. 2). All of the components 17, 28, 29 are rigidly connected to the faces 24, 25.

The faces 24, 25 are essentially identical. Therefore, only one set of reference numerals will be utilized to describe the details thereof.

Associated with the faces 24, 25 are a plurality of cart tines, the individual tines being shown by the reference numeral 31 in FIGS. 1 and 2. In the embodiment illustrated in FIG. 1 five tines 31 are shown associated with each of the faces 24, 25, but it is to be understood that almost any number of tines 31 may be provided as long as they properly support the business forms and can be spaced a distance to allow the passage of stacker tines therebetween (as will be described hereafter). In the embodiment illustrated in FIG. 2, each of the tines 31 is of sheet metal bent into a channel shape and having a hook portion 32 at one end thereof which cooperates with slots 33 formed in the faces 24, 25. By providing a plurality of different sets of slots 33 at different vertical locations along the faces 24, 25 the positions of the tines 31 along the faces 24, 25 may be adjusted, and thus the form stacking capacity of each of the cart faces 24, 25 are individually adjustable. The tines 31 have top faces 34 thereof which actually engage and support the forms—as illustrated for the stack of forms 15 in FIG. 1. The surfaces 34 are substantially perpendicular to the faces 24, 25, e.g. they make an angle $\alpha$ with respect to the horizontal.

In order to facilitate movement of the cart, at the top of the cart 11, associated with the upper support structure 27, may be provided a plurality of handles 37 which extend upwardly from the faces 24, 25. In the preferred embodiment illustrated in FIGS. 1 and 2 four handles 37 are provided, which may have rubber or plastic grips on the tops thereof, extending upwardly from the support bars 38 (see FIG. 1), and facilitating ready grasping and movement of the cart 11.

The cart 11 also has latches associated therewith for cooperating with latching mechanisms on the stacker 10 to latch the cart 11 in place with respect to the stacker 10 until a particularly desired size stack 15 has been formed, and the cart 11 is ready to be moved away (either to have a stack formed in association with the other face thereof, or to be transferred to a position adjacent a use piece of equipment). Typically the latches comprise a latch arm 40 which are seen in each of FIGS. 1, 2, and 8. Each latch 40 is preferably a piece of relatively thin steel plate which is welded or otherwise rigidly affixed to or adjacent the base 20 (e.g. to a face 24, 25), extending outwardly from the faces 24, 25, and generally horizontal. Each of the latches 40—as seen most clearly in FIG. 8—includes a linear cam portion 41 and a latch depression 42, as well as a support piece 43 which is actually connected to the cart 11.

Figures 5, 6, 7, 8:
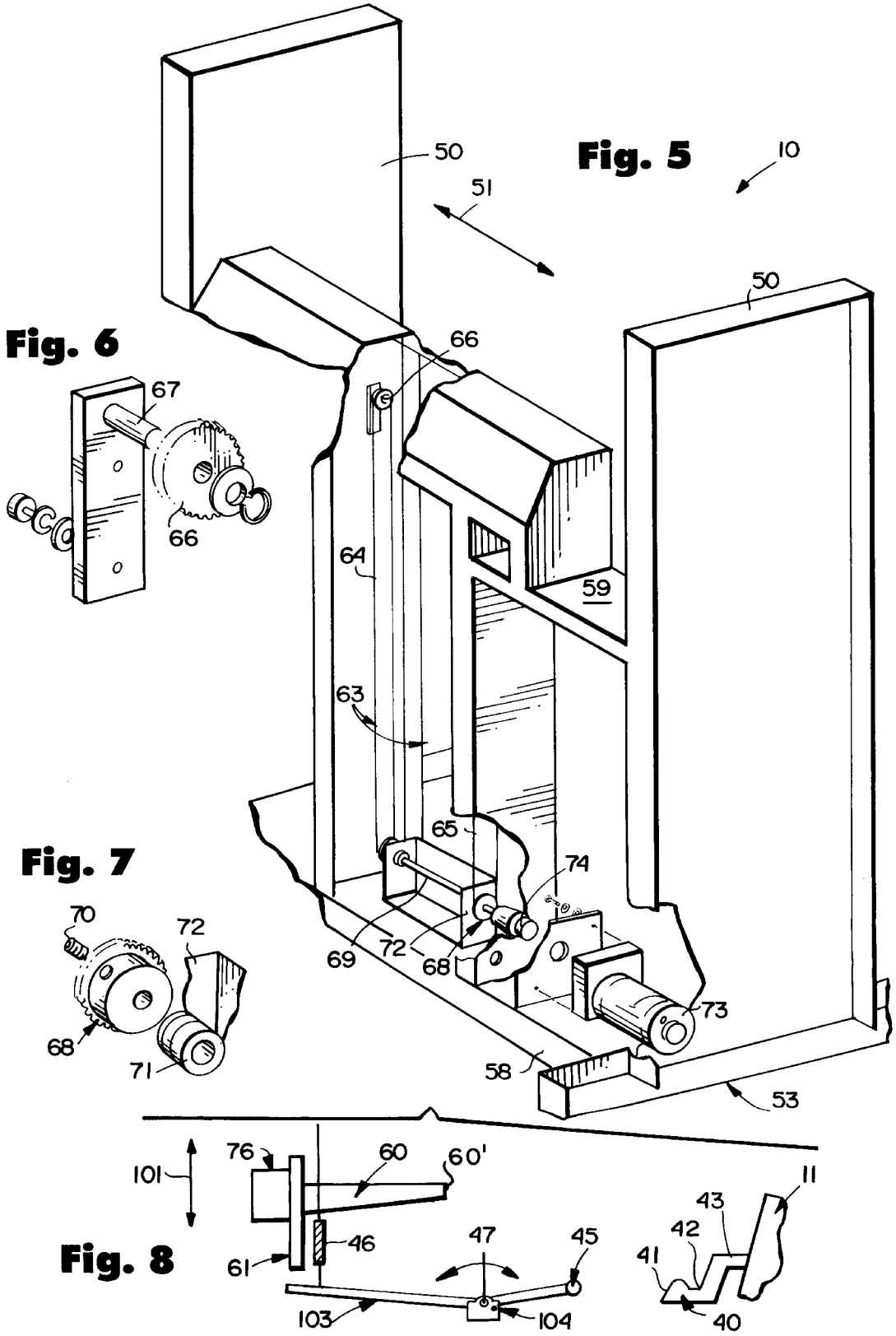
FIG. 5 is a top perspective detail view of the stacker of FIGS. 1, 3, and 4, particularly showing the elevator mechanism associated therewith.
FIG. 6 is a detailed top perspective view of a top sprocket of the elevator mechanism of FIG. 5.
FIG. 7 is a view like that of FIG. 6 for a bottom sprocket mechanism.
FIG. 8 is a side schematic view, primarily in elevation but partly in cross section, schematically showing an exemplary latching mechanism and latch that may be utilized with the stacker and cart, respectively, according to the invention.

As seen in FIG. 8, at least one latch mechanism 44 is associated with the stacker 10 to cooperate with the latches 40. At least one latch mechanism 44 typically comprises a latch rod 45 which is cammed upwardly against the bias of the spring bias of spring 46 acting on arm 103 pivoted about axis 47 so that the latch rod 45 moves into the latch depression 42 but will not come out of the latch depression 42 unless it is pivoted again about the pivot axis 47.

The vertical stacker 10 includes a housing having first and second generally vertical side walls 50 (see FIGS. 1, 3, and 5 in particular) which are substantially parallel to each other and spaced in a first dimension 51. As seen in FIG. 2, the cart tines 31 are also spaced from each other in a dimension 51, and parallel to each other, the spacing 52 therebetween being larger than the widths of the stacker tines, as will be hereinafter described.

Figure 3:
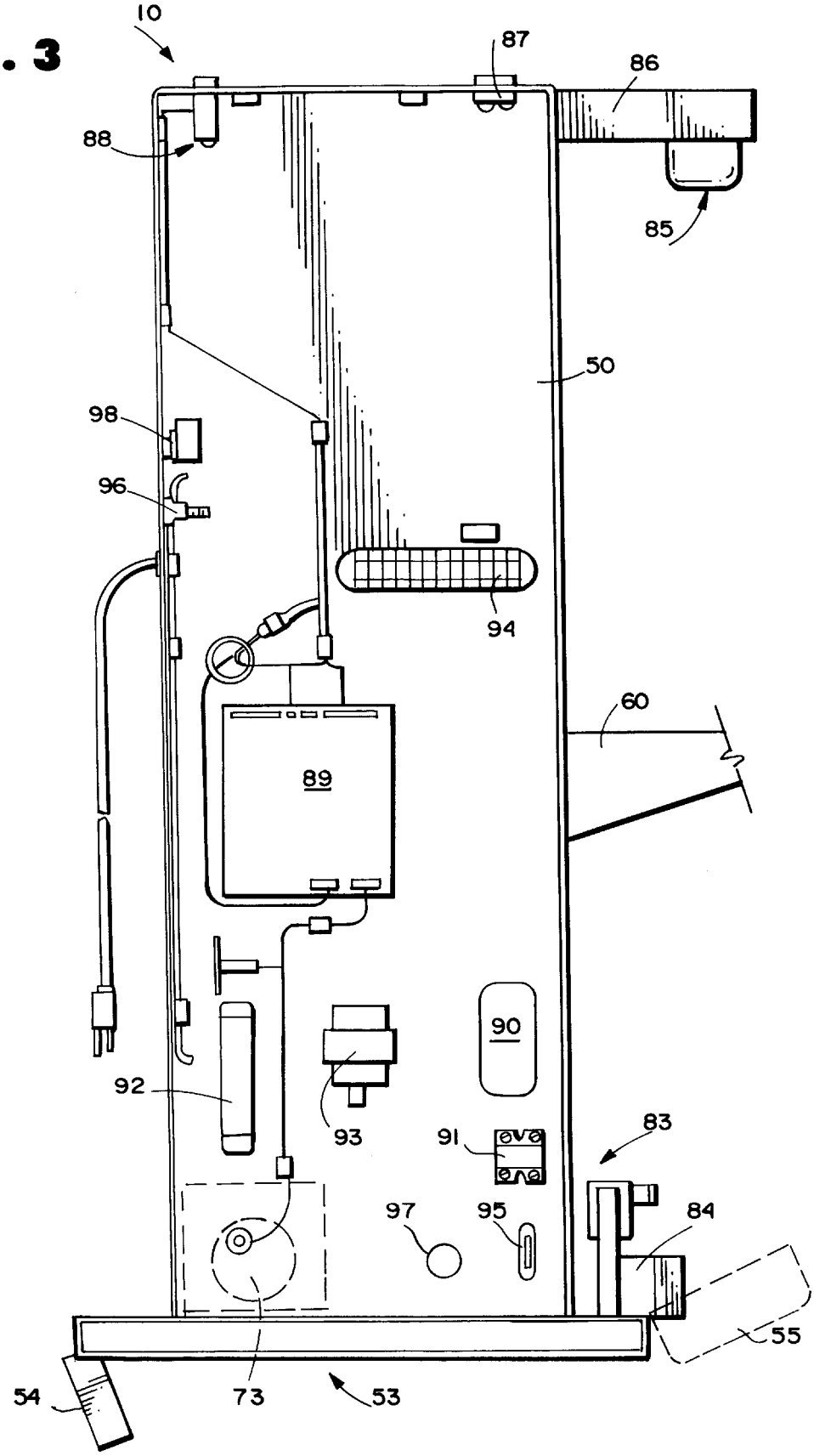
FIG. 3 is a side detail view of the stacker of FIG. 1, showing a number of the electrical components associated therewith.

The stacker 10 also includes a housing including a base, shown generally by reference numeral 53 in FIGS. 1, 3, and 5. As perhaps best seen in FIG. 1 the base 53 includes support portions 54, 55 which mount the side walls 50 of the housing so that the side walls 50 are inclined with respect to the vertical more than 2 degrees, tilted in a second dimension 56 (see FIG. 1). The degree of tilt in the dimension 56 while greater than four degrees typically is about 15 degrees, and in any event is essentially identical to the angle $\alpha$ (about 5–25 degrees, preferably 5–20 degrees and most preferably about 15 degrees). This degree of tilt in the second dimension 56 is indicated by angle $\alpha'$ in FIG. 1. $\alpha'$ is typically approximately equal to $\alpha$ (e.g. if $\alpha=16°$, $\alpha'=15°$). Of course, the angle $\alpha$ may be adjusted by adjusting the height and manner of connection of the support portion 54 which—through the support portion 55—engages the floor 57 of the building in which the assembly 10, 11 is utilized. Various cross braces of any desired configuration, such as the bottom cross base brace 58 (see FIG. 5) connected to the base 53, and other cross braces 59 connected further up along the side walls 50, may be provided.

Figure 4:
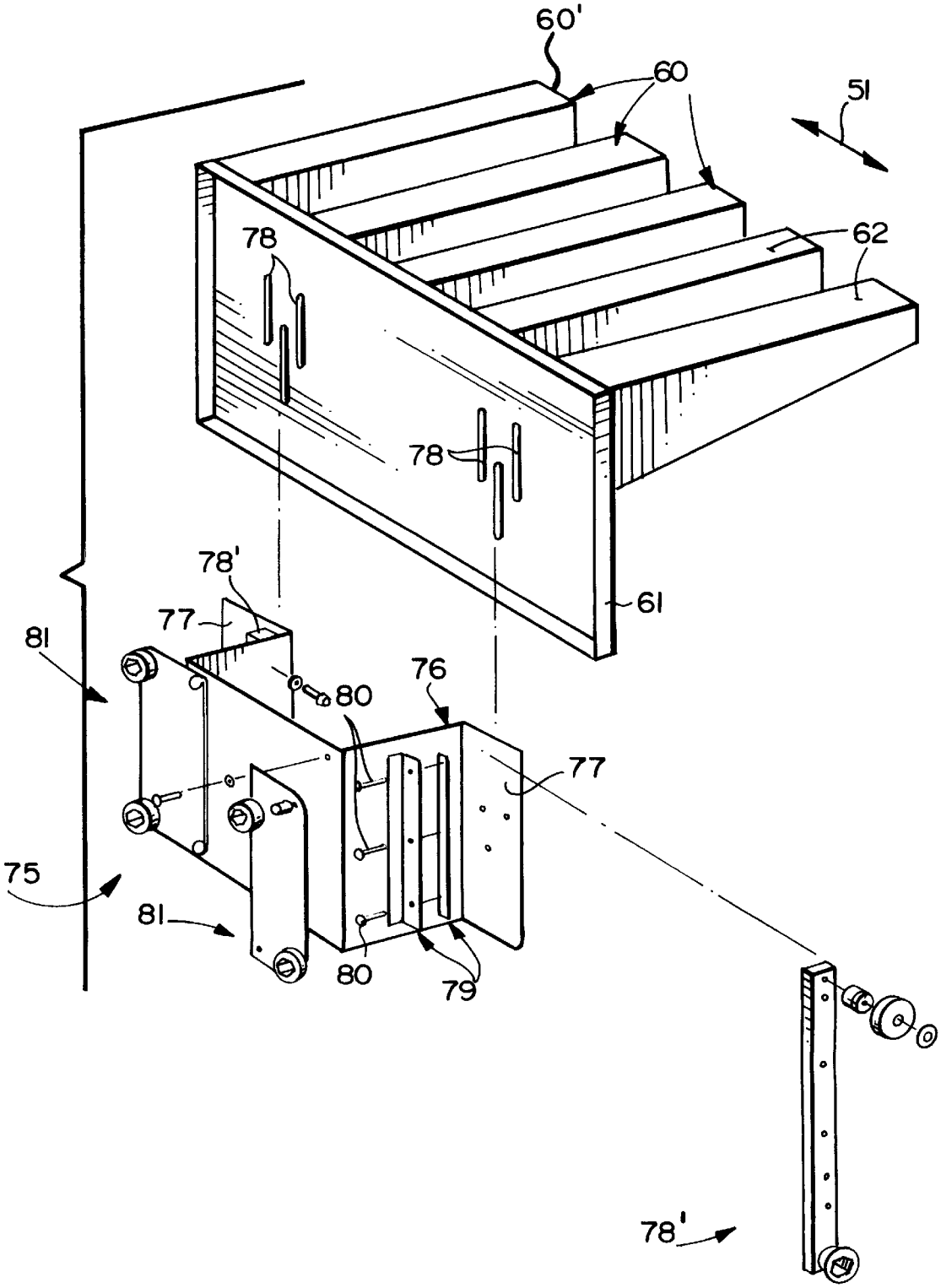
FIG. 4 is a rear perspective exploded view of the stacker tines and support mechanism for supporting the tines with respect to the elevator mechanism of the stacker, according to the present invention.

Associated with the stacker 10 are a plurality of forms-supporting stacker tines 60, seen in FIGS. 1, 3, and 4. The tines 60 are very similar in construction to the tines 31, typically being channel shaped sheet metal, most preferably rigidly welded or otherwise connected to a support plate 61 (see FIG. 4). The tines 60—as seen in FIG. 4—are also parallel to and spaced from each other in the dimension 51, have free ends 60' and have top surfaces 62 thereof which actually engage the forms, the top surfaces 62 being substantially parallel to the surfaces 34 of the tines 31 (although preferably they differ by a degree or so—e.g. if surface 34 is 16° (=$\alpha$) to the horizontal, surface 62 is 15° (=$\alpha'$) to the horizontal). The direction of tilt is such that the free end 60' of the tines 60 are at substantially the lowest point of the top surface 62, as illustrated in FIG. 1. The tines 60 each have a width which is less than the spacing 52, as seen schematically in FIG. 2.

The stacker 10 further comprises an elevator mechanism, shown in dotted line at 63 in FIG. 1 and shown in more detail in FIG. 5—which cooperates with the tines 60 to move them generally vertically—as indicated by arrow 64 in FIG. 1—with respect to the side walls 50, and with respect to the stationary tines 31 of the cart 11. The elevator mechanism 63 may comprise hydraulic or pneumatic cylinders, rotating threaded rods with traveling nuts, belts, jacks, or a wide variety of conventional other mechanisms, but in the preferred embodiment seen in FIGS. 1 and 5 comprises a chain and sprocket mechanism.

The elevator mechanism 63 comprises a pair of endless chains 64, 65 (see FIG. 5) each mounted at the top thereof by an idler sprocket 66 (FIGS. 5 and 6) which rotates about a horizontal axis defined by the support shaft 67 (FIG. 6), and supported at the bottom thereof by a drive sprocket 68 (see FIGS. 5 and 7) held to the drive shaft 69 by a set screw 70 (FIG. 7). The drive shaft 69 extends through a radial bearing 71 in a support bracket 72. The drive shaft 69, and the drive sprocket 68 connected thereto, are driven by an electric motor 73 (FIG. 5) which is connected through a coupling 74 to the drive shaft 69.

The tines 60 are connected to the chains 64, 65 via the support plate 61 and the support assembly shown generally by reference numeral 75 in FIG. 4. The assembly 75 has a generally U-shaped bracket 76 with top flange portions 77 thereof which are connected by fasteners (not shown) to the slots 78 in the plate 61. The side faces of the U-shaped brackets 76 are connected to tracking bar 78, (the left most of which is shown in connected position in FIG. 4 and the right most of which in exploded position), e.g. adjacent to chain straps, such as for the chain strap 79 illustrated in FIG. 4. The chain straps 79 are connected by fasteners 80 at a plurality of different points to the chains 64, 65 so that the brackets 76, plate 61, and tines 60 move up and down with the chains 64, 65. A pair of roller guide plates 81 may also be mounted on the cross piece of the U-shaped bracket 76 to facilitate vertical guiding movement of the bracket 76.

Various sensors and other components are also provided associated with the stacker 10. The relative positions of the sensors and some electrical components are best seen in FIG. 3. The structure 83 comprises a sensor for sensing the position of the cart 11 in proper position—as illustrated in FIG. 1—so that appropriate form stacking may be accomplished. The sensor 83 in the preferred embodiment comprises an interlock switch which is mechanically actuated when the face 24, 25—or some other component of the cart 11—physically comes into contact therewith. However, it is to be understood that the sensor 83 may alternatively comprise a photoelectric, or any other type of conventional non-mechanical proximity sensor. The sensor 83 preferably is mounted on the base 53, and adjacent a cart guide bracket 84.

Mounted adjacent the tops of the side walls 50 a forms position sensor—shown schematically by reference 85 in FIGS. 1 and 3—may be provided, for example mounted by an arm 86 to the top of one or both of the side walls 50. The sensor 85 may be a photoelectric or any other type of non-mechanical proximity sensor and senses when the build up of forms 13 on the tines 60 has taken place. When a certain build up is sensed, sensor 85 ultimately sends a signal to the motor 73 to lower the tines 60. The tines 60 cannot be moved (that is the motor 73 will not operate) unless the sensor 83 senses the proper position of the cart 11.

FIG. 3 also indicates an indicator lamp 87 which is mounted adjacent the tops of one or both of side walls 50 and which is illuminated when a predetermined height of forms 13 is in a stack 15 on the tines 60. A plurality of sensors may be provided along the side walls 50 to sense various positions of the tines 60 to determine when the particular desired size has been reached.

Other electrical components illustrated schematically in FIG. 3 include stacker unload and conveyor (12) jog switches, shown schematically at 88 are manually operated, a logic board 89 containing the control components for electrical interrelationship and control of the various components, a time delay mechanism 90, solid state relay 91, a terminal block 92 with RC network, a transformer assembly 93 (e.g. 24 volt), another terminal block 94, a fuse holder assembly 95, a fuse holder and lamp 96, and a bridge rectifier 97. The main control, on/off, switch is indicated at 98.

FIG. 8 schematically illustrates not only how the latch 40 may cooperate with latching mechanism 44, but how the latching mechanism 44 may be automatically released. For example, the U-shaped bracket 76 in FIG. 4 is attached to elevator mechanism 63 in FIG. 5 and moves up and down (see arrows 101 in FIG. 8) therewith. When the elevator is moved to the lowermost position, in which case the tines 60 no longer support the forms 13 but rather the stack of forms 15 is supported by the tines 31—the bottom of support plate 61 shown in FIG. 4 contacts the arm 103 and pivots the latch rod 45 about the axis 47 against the bias of spring 46 so that it is out of the latch depression 42, and therefore the cart 11 can be removed. When a cart 11 is sensed by sensor 83 see FIG. 3, and an absence of stacked forms 15 is sensed by sensor 85, the motor 73 operates in the up direction until the tines 60 are again sensed by sensor 83. As the motor 73 moves the elevator upward, the support plate 61 (FIG. 4) moves upwardly releasing the contact with arm 103 which under the influence of spring 46, until stopped by the stop 104, pivots the latch rod 45 about the axis 47 so that the latch rod 45 is in the latch depression 42 and the cart 11 is secured.

Figure 9:
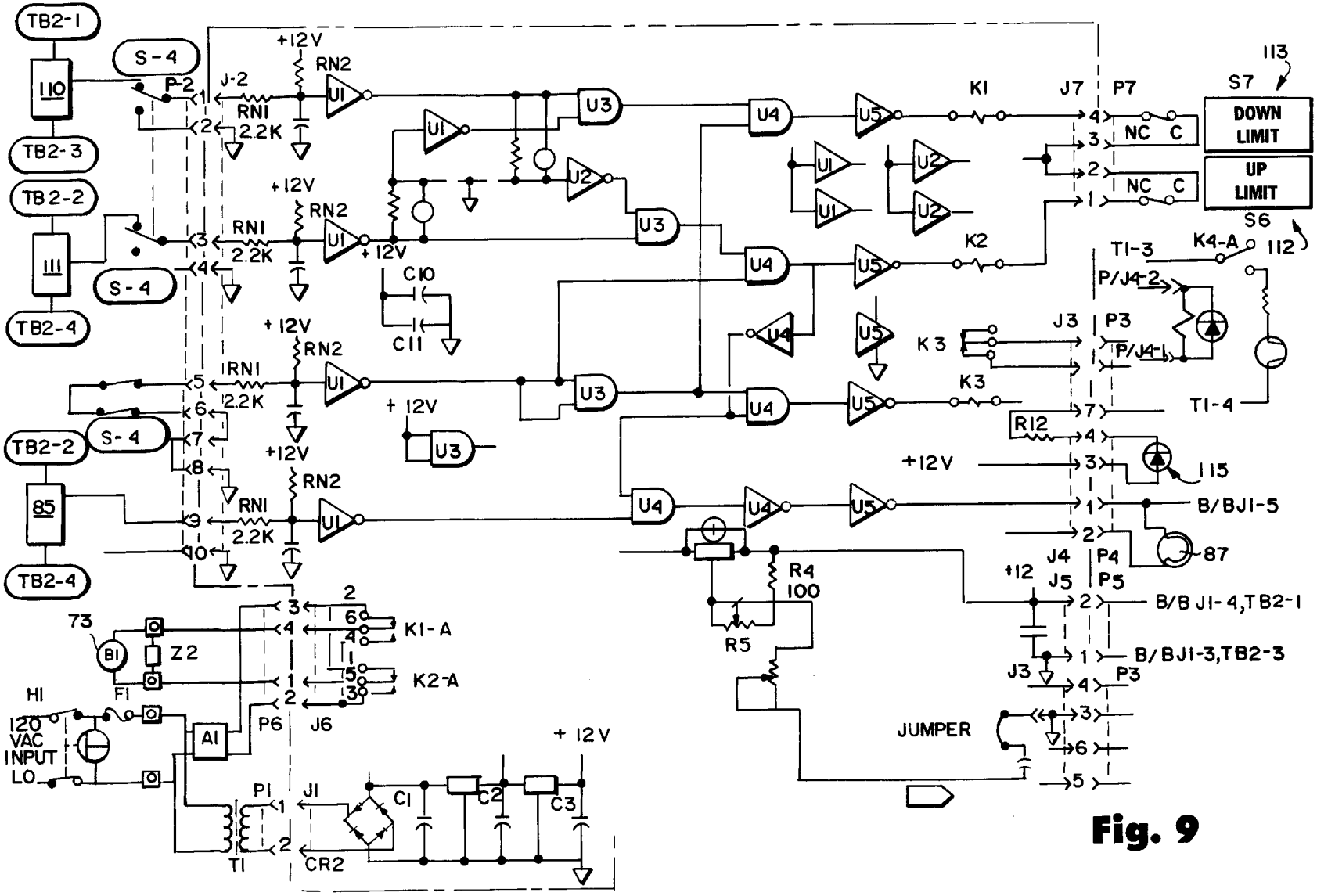
FIG. 9 is an electrical schematic of the exemplary controls utilizable with the equipment of FIGS. 1 through 8.

Various electrical components which provide control means for controlling operation of the elevator mechanism 63, and receiving input from the sensors 83, 85, etc., and the majority of components of which are mounted on the logic board 89, are illustrated schematically in FIG. 9. The electrical components illustrated in FIG. 9 have conventional designations. A "down" sensor 110 and an "up" sensor 111 are associated with the elevator mechanism as are the up and down limits switches 112, 113, respectively. The mechanism 115 is associated with the conveyor 12, folder 14, or printer associated therewith, so that when a particular full stack is determined to have been made a folder 14, or other equipment associated therewith, will be temporarily stopped or slowed down until a new stack can be formed.

Operation

In typical operation of the equipment heretofore described, an empty face (e.g. 24) of the cart 11 is moved into operative association with the stacker 10, as illustrated in FIG. 1, by an operator grasping the handles 37 and wheeling the cart into position within guide brackets 84 provided on the base 53 of the stacker 10. The latch 40 cam 41 cams the cam rod 45 upwardly until it is pressed by the spring 46 into the latch depression 42, this occurring for both latches 40 associated with the face 24 so that the cart 11 is positively positioned in place with respect to the stacker 10 so that the tines 31, 60 intermesh (FIG. 2). In this position the sensor 83 senses that the cart 11 is properly positioned, and then the motor 73 of the elevator mechanism 63 is automatically operated to raise the tines 60 to their upward most position as illustrated in FIG. 1, immediately adjacent the discharge from the conveying mechanism 12.

The forms 13 come from a folder 14, printer, or the like, along the conveyor mechanism 12 in a tilted and loosely compacted connected form. As the forms 13 cascade over the end of the conveyor 12 they move onto the elevator tines 60.

The forms 13 pack height on the tines 60 is sensed by the reflective type photo electric sensors 110, 111 which are set to ensure form stack compression. The stack is compressed by the weight of the forms 13 as the stack is vertically formed, and the slow movement of the forms 13 along the conveyor mechanism 12 allows ample time for gravity compression and ensures accurate stacking.

As the stack increases in size, the motor 73 is controlled to lower the tines 60 until finally the desired height has been reached. At the desired height the tines 60 will have passed between the spaces 52 of the tines 31 so that the top surfaces 62 of the tines 60 are below the top surfaces 34 of the tines 31. In this position the now vertical stack of forms 15 is supported by the tines 31 and the stack has been properly formed and the cart 11 is ready to be moved.

The operator then separates the forms 13 at the end of the conveying mechanism 12 (start of the tines 60) and pushes the last of the forms 13 onto the stack 15. The unload switch 88 is then operated, moving the tines 60 in the dimension 64, downwardly, to a lowermost position. Depending upon the desired stack height the tines may have been above the tines 31 prior to this unload action. In any event the bracket assembly 76, with supported tines 60, is moved to its lowermost, causing the latch mechanism 44 to be released by the support plate 61, engaging and pivoting the arm 103 so that the rod 45 moves out of the latch depression 42. The operator then grasps the handles 37 and moves the cart 11 out of position in association with the stacker 10. When the cart 11 is out of position the motor 73 cannot operate. Then either a fresh (empty) face of the same cart 11 is moved into position with the stacker 10, or if both faces of the cart 11 are full the entire cart 11 is moved away from the stacker 10 and a new cart 11 put in its place.

The cart 11 is moved to equipment that will utilize the stack 15 of forms 16. At this position—as illustrated in the righthand side and schematically in FIG. 1—the forms 16 pass over the rollers 17 and the forms 16 move in the direction 18 (FIG. 1) to the use device, being unfolded from the fanfold configuration of stack 15 during this take-off.

At no time is it necessary for the operator to tilt the cart, and the forms are properly stacked, without curling or damage.

It will thus be seen that according to the present invention an effective stacker, cart, and stacker and cart assembly have been provided for the stacking of business forms. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A stacker comprising:

a housing including first and second generally vertical side walls, and a base, said side walls substantially parallel to each other and spaced in a first dimension;

a plurality of forms-supporting tines parallel to and spaced from each other in said first dimension, and having free ends and top surfaces;

said base including support portions which mount said side walls and tines so that at least one of said tines and said side walls are inclined with respect to the vertical more than two degrees, tilted in a second dimension, substantially perpendicular to said first dimension and so that said tine free ends are substantially the lowest portion of said top surfaces;

an elevator mechanism for moving said forms-supporting tines together in a generally vertical dimension with respect to said side walls; and a cart sensor mounted on or adjacent said base for sensing positioning of a cart in operative association with said forms-supporting tines.

2. A stacker as recited in claim 1 further comprising a latching mechanism mounted adjacent said blase for cooperating with a latch on a cart to latch a cart in place until released.

3. A stacker as recited in claim 2 further comprising a forms-position sensor for sensing the position of stacked forms on said forms-supporting tines.

4. A stacker as recited in claim 3 further comprising control means for effecting movement of said elevator mechanism with respect to said side walls, and thus movement of said forms-supporting tines, in response to said forms-position sensor.

5. A stacker as recited in claim 1 wherein said side walls and forms-supporting tines are inclined to the vertical about 5–20 degrees in said second dimension.

6. A stacker comprising:

a housing including first and second generally vertical side walls, and a base, said side walls substantially parallel to each other and spaced in a first dimension;

a plurality of forms-supporting tines parallel to and spaced from each other in said first dimension, and having free ends and top surfaces;

said base including support portions which mount said side walls and tines so that at least one of said tines and said side walls are inclined with respect to the vertical more than two degrees, tilted in a second dimension, substantially perpendicular to said first dimension and so that said tine free ends are substantially the lowest portion of said top surfaces;

an elevator mechanism for moving said forms-supporting tines together in a generally vertical dimension with respect to said side walls; and an indicator lamp for indicating when a stack of forms of a predetermined size has been stacked on said forms-supporting tines, said indicator lamp mounted adjacent the top of said side walls.

7. A stacker comprising:

a housing including first and second generally vertical side walls, and a base, said side walls substantially parallel to each other and spaced in a first dimension;

a plurality of forms-supporting tines parallel to and spaced from each other in said first dimension, and having free ends and top surfaces;

said base including support portions which mount said side walls and tines so that at least one of said tines and said side walls are inclined with respect to the vertical more than two degrees, tilted in a second dimension, substantially perpendicular to said first dimension and so that said tine free ends are substantially the lowest portion of said top surfaces;

an elevator mechanism for moving said forms-supporting tines together in a generally vertical dimension with respect to said side walls; and a forms-position sensor for sensing the position of stacked forms on said forms supporting tines.

8. A stacker as recited in claim 7 further comprising control means for effecting movement of said elevator mechanism with respect to said side walls, and thus movement of said forms-supporting tines, in response to said forms-position sensor.

9. A stacker comprising:

a housing including first and second generally vertical side walls, and a base, said side walls substantially parallel to each other and spaced in a first dimension;

a plurality of forms-supporting tines parallel to and spaced from each other in said first dimension, and having free ends and top surfaces;

said base including support portions which mount said side walls and tines so that at least one of said tines and said side walls are inclined with respect to the vertical more than two degrees, tilted in a second dimension, substantially perpendicular to said first dimension and so that said tine free ends are substantially the lowest portion of said top surfaces; and an elevator mechanism for moving said forms-supporting tines together in a generally vertical dimension with respect to said side walls, said elevator mechanism comprising: a pair of endless chains each connected to an idler sprocket and a drive sprocket; a drive for rotating said drive sprockets; and a support operatively connecting said forms-engaging tines to said chains for movement therewith.

10. A cart for transporting business forms, comprising:

a base;

a first forms-engaging face mounted to said base and having a fixed angular position making an angle of about 5–25 degrees with respect to the vertical;

a second forms-engaging face having a fixed angular position making the same angle with respect to the vertical as said first face, and also mounted to said cart base;

transport means on said base for facilitating rolling movement of said base;

a first plurality of cart tines immovably fixed to and extending outwardly from said first face and parallel to and spaced from each other in a first dimension;

a second plurality of cart tines immovably fixed to and extending outwardly from said second face and parallel to and spaced from each other in said first dimension; and said first and second faces mounted so that individual tines of said first and second pluralities of tines are substantially co-planar.

11. A cart as recited in claim 10 further comprising first and second latches mounted to or adjacent said base, said first latch extending outwardly from said first face generally perpendicular thereto, and said second latch extending outwardly from said second face generally perpendicular thereto.

12. A cart as recited in claim 10 further comprising adjustment means for adjusting the positions of said first and second pluralities of tines with respect to said first and second faces, respectively, to individually vary the vertical position of said tines on said faces, and thus the form stacking capacity of said cart faces.

13. A cart as recited in claim 10 further comprising a plurality of handles, extending upwardly from said faces, facilitating movement of said cart.

14. A system for substantially vertically stacking forms, comprising:

a stacker comprising: a housing including first and second generally vertical side walls, and a stacker base, said side walls substantially parallel to each other and spaced in a first dimension; a plurality of forms-supporting stacker tines parallel to and spaced from each other in said first dimension; and an elevator mechanism for moving said forms-supporting stacker tines together in a generally vertical dimension with respect to said side walls; and a cart comprising: a cart base; a forms-engaging face mounted to said cart base; transport means on said cart base for facilitating rolling movement of said cart base; and a plurality of cart tines extending outwardly from said face and parallel to and spaced from each other in said first dimension a spacing greater than the width of at least some of said stacker tines, so that when said cart is brought into operative position with said stacker, said stacker and cart tines do not interfere with each other as said stacker tines are moved by said elevator mechanism relative to said cart tines.

15. A system as recited in claim 14 further comprising a cart sensor mounted on or adjacent said stacker base for sensing positioning of said cart in operative association with said stacker, with said cart and stacker tines intermeshed, said sensor precluding operation of said elevator mechanism unless said cart is in place with respect to said stacker.

16. A system as recited in claim 15 further comprising a latching mechanism mounted adjacent said stacker base for cooperating with a latch on said cart on or adjacent said cart base, said latching mechanism and latch cooperating to latch said cart in place in operative association with said stacker until released.

17. A system as recited in claim 14 wherein said stacker base includes support portions which mount said side walls so that they are inclined with respect to the vertical more than two degrees, tilted in a second dimension, substantially perpendicular to said first dimension; and wherein said cart face has a fixed angular position that is inclined to the vertical the same amount as said stacker side walls are inclined to the vertical, so that said stacker and cart tines are substantially parallel.

18. A system as recited in claim 14 further comprising adjustment means for adjusting the positions of said cart tines with respect to said cart face to vary the form stacking capacity of said cart.

19. A system as recited in claim 14 wherein said cart face comprises a first face having first cart tines and said first face has a fixed angular position making an angle of about 5–25 degrees with respect to the vertical; and wherein said cart includes a second forms-engaging face having a fixed angular position making the same angle with respect to the vertical as said first face, and also mounted to said cart base; and a second plurality of cart tines extending outwardly from said second face and parallel to and spaced from each other in said first dimension a spacing greater than the width of at least some of said stacker tines, so that when either face of said cart is brought into operative position with said stacker tines, either said first or second cart tines do not interfere with each other as said stacker tines are moved by said elevator mechanism.

20. A system as recited in claim 19 wherein said cart further comprises a plurality of handles, extending upwardly from said faces, facilitating movement of said cart.

21. A system as recited in claim 14 in combination with one of a printer, and folder and a conveying mechanism, connected to said stacker on an opposite portion thereof from said cart, said stacker receiving forms from said printer or folder and conveying mechanism.

22. A system as recited in claim 21 further comprising a forms-position sensor for sensing the position of stacked forms on said stacker forms-supporting tines.

23. A system as recited in claim 22 further comprising control means for effecting movement of said elevator mechanism with respect to said side walls, and thus movement of said forms-supporting stacker tines, in response to said forms-position sensor, and for sending a control signal to said printer and conveying means.

* * * * *